United States Patent [19]

Shields

[11] 4,141,565

[45] Feb. 27, 1979

[54] ADJUSTABLE SKI STRAP

[76] Inventor: Michael P. Shields, 3956 Deer Ave., Sherman Oaks, Calif. 91423

[21] Appl. No.: 764,820

[22] Filed: Feb. 2, 1977

Related U.S. Application Data

[63] Continuation-in-part of Ser. No. 667,121, Mar. 15, 1976, abandoned.

[51] Int. Cl.[2] ..... A63C 11/02

[52] U.S. Cl. ..... 280/11.37 A; 24/16 PB; 24/73 SG; 24/81 SK

[58] Field of Search ..... 280/11.37 A, 11.37 K; 24/16 PB, 81 SK, 73 SG, 17 AP, 20 EE; 224/45 S, 5 Z

[56] References Cited

U.S. PATENT DOCUMENTS

| | | | |
|---|---|---|---|
| 3,272,526 | 9/1966 | Rumaner | 280/11.37 K |
| 3,279,008 | 10/1966 | Wallach | 24/16 PB |
| 3,284,091 | 11/1966 | Spier | 280/11.37 E |
| 3,761,999 | 10/1973 | Morgan | 24/16 PB |
| 3,837,047 | 9/1974 | Bunnell | 24/16 PB |

FOREIGN PATENT DOCUMENTS

| | | | |
|---|---|---|---|
| 2228243 | 1/1973 | Fed. Rep. of Germany | 24/16 PB |

*Primary Examiner*—Joseph F. Peters, Jr.
*Assistant Examiner*—Milton L. Smith
*Attorney, Agent, or Firm*—Lyon & Lyon

[57] ABSTRACT

An adjustable securing strap which is adapted to be secured to a snow ski for holding together a pair of snow skis. The strap is of integral construction and is comprised of an extended tongue portion, a tongue receiving portion which is to be secured to the upper surface of one of the skis and a flexible strap portion which extends between the tongue and receiving portions. The tongue receiving portion is provided with a pair of hingedly mounted lateral tongue retaining walls and a plurality of undercut teeth which extend between the hinged walls and are engagable with a plurality of oppositely cut teeth on the tongue portion of the strap. The engaged teeth and retaining walls hold the tongue portion firmly within the tongue receiving portion when the strap is disposed about a pair of skis or the like.

14 Claims, 8 Drawing Figures

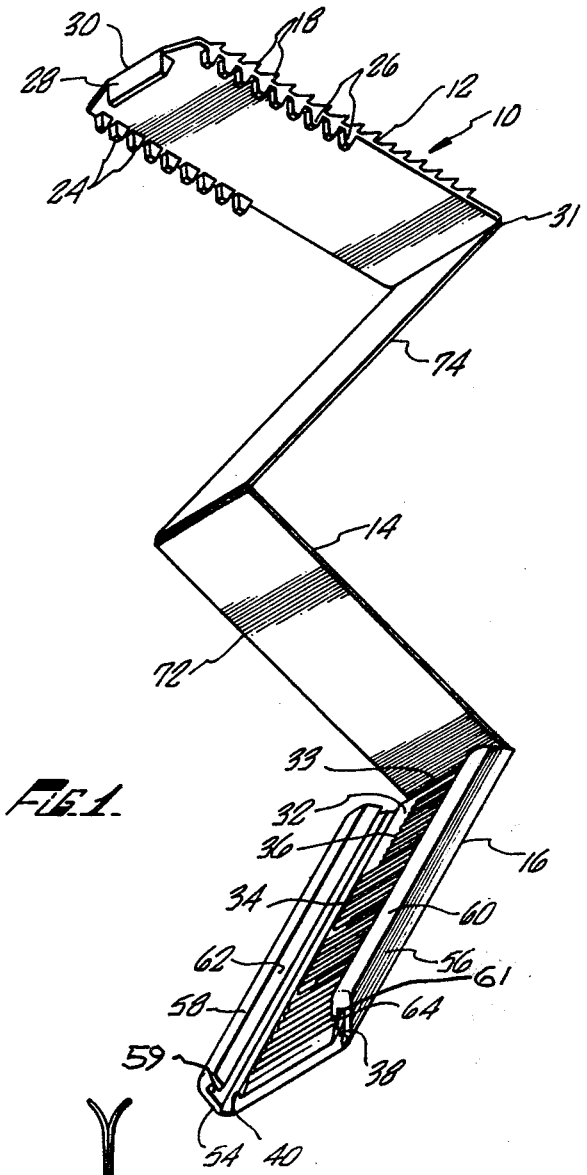
FIG. 1.
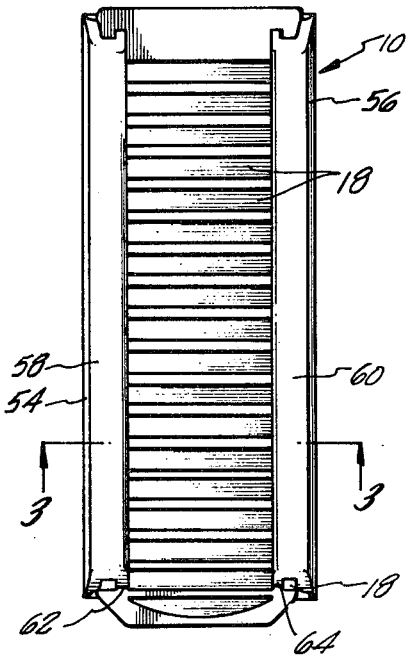
FIG. 2.
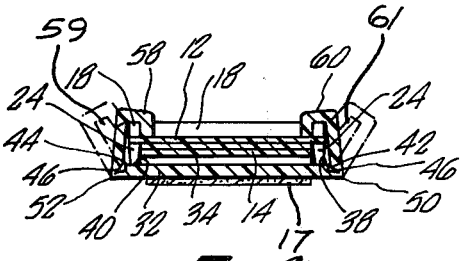
FIG. 3.
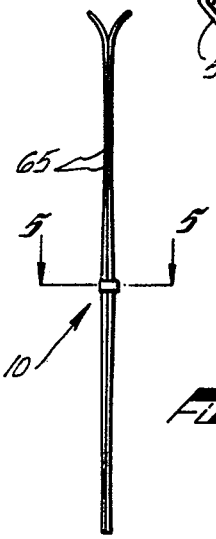
FIG. 4.
FIG. 5.
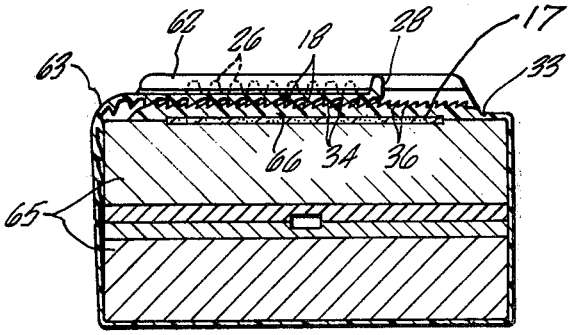

ADJUSTABLE SKI STRAP

This is a continuation-in-part of the co-pending parent application, Ser. No. 667,121, filed Mar. 15, 1976 and entitled ADJUSTABLE SKI STRAP and now abandoned.

BACKGROUND OF THE INVENTION

For years pairs of skis have been held together to facilitate carrying and storage by what are commonly termed rubbers. These rubbers comprise a pair of elastic rubber straps which fit about the toe and tail portion of the skis each having a metal loop at one end and a metal hook configuration at the other. The metal hook fits about the side of one of the skis extending over both the upper and lower edges thereof and the strap is extended about the skis with the loop at the extended end being placed over an external flange extending outwardly from the metal hook thereby securing the skis together with the bases thereof facing each other.

While a pair of rubbers will hold a pair of skis together, there are several problems associated both with their construction and use. Firstly, because they are constructed of rubber they are subject to rapid deterioration. This problem is particularly acute when they are used in areas having a high ozone level in the air as the ozone rapidly deteriorates rubber products, particularly when the rubber is in an extended or stretched disposition as is the case with rubber straps disposed about a pair of skis.

In addition to the short life of the rubber straps, they also constitute a substantial safety hazard to the skier as they are commonly carried on the skier's person while he is skiiing and the metal hooks at the ends of the straps can easily bruise or cut the skier or rip his clothing should he fall and land thereon. It would therefore be highly desirable to provide an adjustable strap which could hold one's skis together to facilitate carrying and storage but which need not be carried on the skier's person and additionally eliminates the need for a metal hook or other rigid protrusion so as not to constitute a safety hazard.

A further problem associated with the rubber strap is encountered while carrying a pair of skis secured together thereby. Because the straps join the skis together at the toe and tail portions of the skis, the skis due to the camber therein are bowed and consequently spaced apart at the centers which is the point along the skis by which they are commonly carried. Consequently persons carrying a pair of skis held together in this fashion frequently pinch their hands between the sharp metal edges along the base of the skis causing painful scrapes, cuts and blisters. This problem cannot be avoided by changing the placement of the rubbers as the rubbers are not adaptable to draw the skis together at the bowed center portions due to the construction of the hook assembly which is so designed as to fit about the shallower toe and tail portions of a ski.

Accordingly, it would be desirable to provide a durable strap for holding a pair of skis together which not only avoids the hazards created by the sharp protuberances commonly found on rubbers, but one which is also adaptable for use at the center of the skis to draw the metal edges of the skis tightly together to prevent any injury which otherwise might be caused thereby as well as to protect the edges from external contact which may cause a dulling of the skis' edges and a corresponding loss in performance.

SUMMARY OF THE INVENTION

Briefly, the invention comprises an adjustable strap particularly adapted to hold together a pair of skis to facilitate carrying and storage thereof. The strap is preferably secured at the tongue receiving end to the top of one of the skis with the tongue portion thereof which defines the other end of the strap being disposed about the skis and inserted into a tongue receiving portion. The tongue and tongue receiving portions have oppositely disposed undercut teeth thereon which cooperate in a mated relationship to prevent withdrawal of the tongue from the tongue receiving portion while allowing the tongue portion to be urged farther therein thereby tightening the strap about the skis. The tongue receiving portion is further provided with hinged retaining walls which, in the closed position, prevent the tongue portion from being dislodged from the tongue receiving portion and in the open position allow simple removal thereof and disengagement of the skis. When not in use, such as while skiing, the tongue portion of the strap is folded into the tongue receiving portion and secured by the hinged retaining walls.

It is the principal object of the present invention to provide an adjustable strap for holding together a pair of skis which is superior to those straps heretofore available.

It is another object of the present invention to provide an adjustable strap for holding together a pair of skis which can be safely and compactly secured to a ski.

It is still another object of the present invention to provide an adjustable strap for holding together a pair of skis which when carried on the person of a skier is very compact and free from external protrusions of the type likely to cause injury if fallen upon while skiing.

It is a further object of the present invention to provide an adjustable strap for holding together a pair of skis which is adaptable for use at the center portions thereof for carrying without the need for additional straps, and at the toe and tail ends of the skis for storage.

It is yet another object of the present invention to provide an adjustable strap for holding together a pair of skis which draws the metal edges of the facing skis together to prevent damage to the edges thereof and to the hands of the person carrying a pair of skis held together by said strap.

It is a still further object of the present invention to provide an adjustable strap for holding together a pair of skis which is highly durable and resists deterioration with age.

It is yet another object of the present invention to provide an adjustable strap for holding together a pair of skis which is of simple construction and economical to manufacture.

It is another object of the present invention to provide a durable and adjustable strap for securing one or more items together.

These and other objects and advantages of the present invention will become apparent from the following detailed description taken in conjunction with the accompanying drawings.

DESCRIPTION OF THE PREFERRED EMBODIMENT

FIG. 1 is a perspective view of the strap of the present invention.

FIG. 2 is a perspective view of the strap in the compact folded position.

FIG. 3 is a sectional view taken along line 3—3 in FIG. 2.

FIG. 4 is a side view of the strap disposed about a pair of skis.

FIG. 5 is an enlarged sectional view taken along line 5—5 in FIG. 4.

Figure 6:
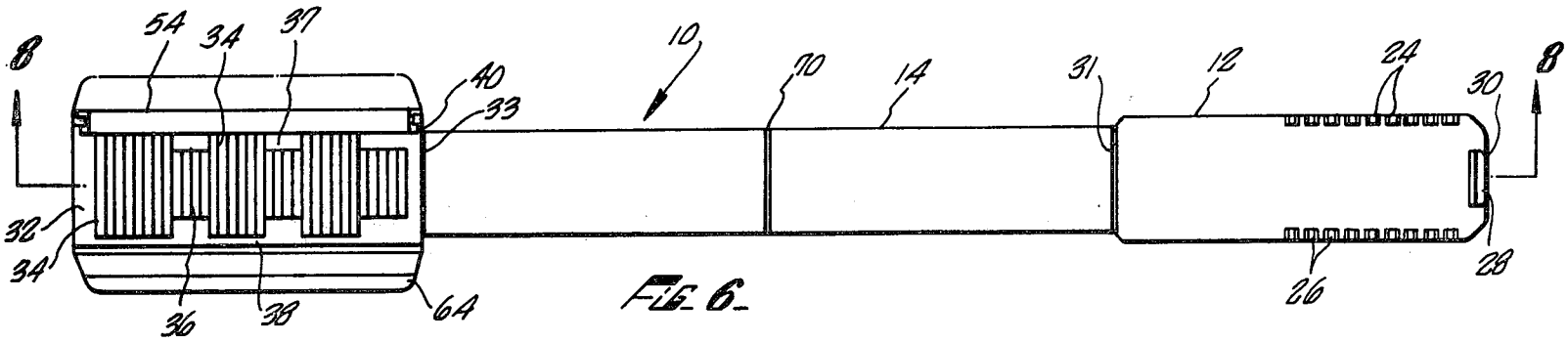
FIG. 6 is a plan view of the strap.
Figure 7:
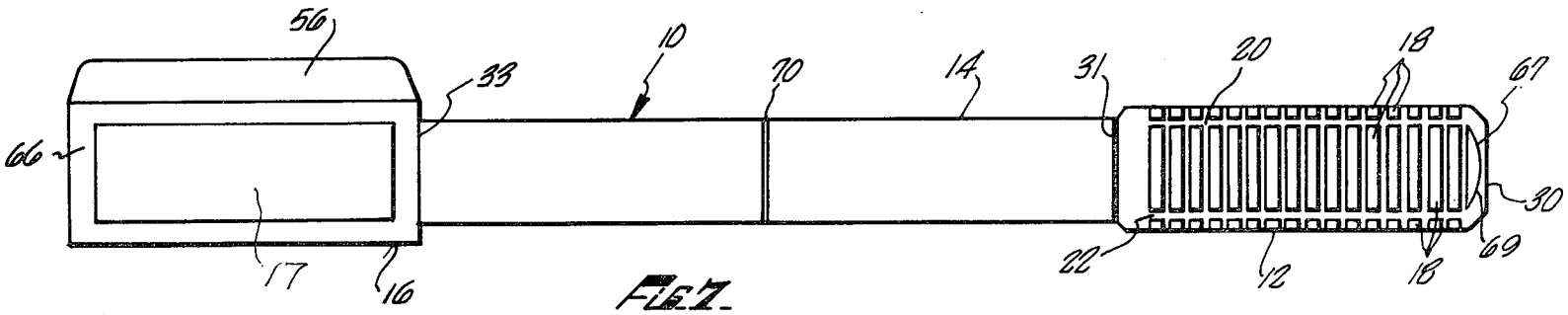
FIG. 7 is a view of the underside of the strap.
Figure 8:
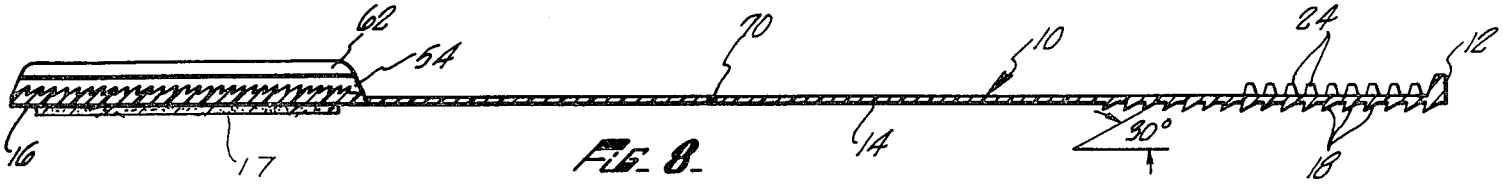
FIG. 8 is a sectional view of the strap taken along line 8—8 in FIG. 6.

Referring now in detail to the drawings, the strap 10 of the present invention is illustrated in FIGS. 6–8 in an extended position ready for use in securing together a pair of skis or the like, as seen in FIGS. 4 and 5, and in FIGS. 2 and 3 in a compact folded position. The strap 10 is comprised of a tongue portion 12, central strap portion 14 and tongue receiving portion 16. In the preferred embodiment of the invention, the strap is of an integral construction preferably of a polypropylene material to provide the living hinges which will be described and the backside 66 of the tongue receiving portion 16 is provided with an adhesive 17 for affixing said portion to one of the skis as represented in FIGS. 5 and 7. In an alternate embodiment, the adhesive can be omitted and the strap completely removed from the skis and carried on the user's person without risk of harm in a fall due to the lack of any sharp protrusions or hooks on the strap 10.

The tongue portion 12 of the strap as best seen in FIGS. 1, 6 and 7 is thin in cross-section [preferably about 0.02 inches (0.05 cm.)] to provide desired flexibility therein and has a plurality of transversely extending undercut teeth 18 on one side thereof sloping upwardly at an angle of about 30° from the horizontal. A pair of longitudinal channels 20 and 22 (see FIG. 7) extend through the plurality of teeth 18 spaced inwardly from the extended ends thereof to facilitate folding of the strap to the position illustrated in FIG. 2. The tongue portion of the strap is also provided with a pair of serrated longitudinal ridges 24 and 26 by which the tongue is held in the tongue receiving portion when the strap is disposed about a pair of skis, as will be described. The ridges 24 and 26 extend along a portion of the lateral sides of the tongue on the opposite side thereof from teeth 18. The serrations in the ridges are provided to maintain the desired flexibility in the tongue portion and a tab 28 is provided at the extended end 30 of the tongue portion to facilitate tightening of the strap about the skis and disengagement of the tongue portion from the tongue receiving portion.

The central strap portion 14 of the strap is integrally joined with both the tongue portion 12 and the tongue receiving portion 16 by living hinges 31 and 33 and is preferably of the same thickness (about 0.02 inches) as the tongue portion to provide the necessary flexibility therein for readily securing the strap 10 a pair of skis or the like. For use as a ski strap, a length of about 4 to 5 inches (10.2 to 12.7 cm.) for the central strap portion 14 has been found highly suitable.

The tongue receiving portion 16 of strap 10 includes a central base portion 32 having a plurality of transversely extending undercut teeth 34 extending therefrom in the opposite direction of the teeth 18 on the tongue portion 12 of the strap. Teeth 34 are sloped toward the tongue portion 12 at the same angle with respect to the horizontal as teeth 18 to properly mate therewith. As shown in FIG. 6, one or more groups 36 of shortened teeth are preferably provided in the tongue receiving portion of the straps to provide flats 37 to accommodate a die removal tool during construction. Additionally, the spacing between adjacent teeth 34 in the tongue receiving portion of the strap is preferably one-half the spacing between the adjacent teeth 18 in the tongue portion because the flexibility desired in the tongue portion is not needed in the tongue receiving portion. The increased number of teeth in the tongue portion additionally provides for a finer adjustment of the tension of the strap about the skis as the tongue portion is urged further into the tongue receiving portion tightening the strap about the skis or the like.

The tongue receiving portion 16 is further provided with a pair of longitudinally extending channels 38 and 40 adjacent to the lateral edges of teeth 34 to accommodate the serrated ridges 24 and 26 of the tongue portion in the folded position. As seen in FIG. 3, the extended transverse edges 42 and 44 of channels 38 and 40 are stepped down at 46 and 48 into living hinges 50 and 52 which are beveled at about 15° with respect to the horizontal to accommodate the tongue retaining walls 54 and 56. The tongue retaining walls are provided with inwardly directed flange portions 58 and 60, each having retaining lips 62 and 64 at the extended ends thereof to define locking channels 59 and 61 which hold the tongue portion 12 of the strap within the tongue retaining portion.

As seen in FIG. 5, when the strap 10 is wrapped about a pair of skis or the like, the teeth on the tongue and tongue retaining portions of the strap are engaged and the flanges and retaining lips of the hinged retaining walls fit over the serrated ridges 24 and 26 of the tongue portion which conversely are disposed within locking channels 59 and 61 to hold the tongue portion within the tongue retaining portion and the teeth thereon in mating relationship. As seen in FIG. 3, when the strap 10 is in the compacted folded position, the flanges and retaining lips fit over the extended ends of the undercut teeth 18 on the tongue portion of the strap to secure the strap in that position.

In use in holding a pair of skis 65 together, as shown in FIG. 5, the skis are pressed together and if the strap 10 is not affixed to one of the skis by the adhesive 17, the backside 66 of the base portion of the tongue receiving portion 16 of the strap is placed against one side of the skis near the center thereof. The central strap portion 14 is then drawn tightly about the skis and with the retaining walls 54 and 56 of the tongue receiving portion 16 moved outwardly therefrom, the tongue portion of the strap is placed against the tongue receiving portion with the respective teeth 18 and 34 thereon in a mating relationship. The hinged retaining walls 54 and 46 are then urged inwardly into position such that the flanges and retaining lips thereon are disposed over and about the serrated ridges 24 and 26 on the tongue portion to thereby secure the tongue portion within the tongue receiving portion and the strap 10 about the skis.

As can be seen at 63 in FIG. 5, when the strap 10 is disposed about a pair of skis, a portion of the tongue portion of the strap may have to be bent around the edges of the skis. Accordingly, the tongue portion must be flexible as noted above. The camber built into the skis tends to urge the skis apart causing the mating pluralities of the teeth to tightly hold the strap in place. If the strap need be tightened, however, this can be accomplished by urging the tongue portion 12 of the strap further into the tongue retaining portion by means of tab 28 as the mating undercut teeth act as a one-way valve in that they allow the tongue portion to be moved further into the tongue receiving portion but prevent any retraction therefrom. In this regard the forward-most tooth 67 on the tongue portion has a rounded forward edge 69 to facilitate tightening.

To remove the strap from the skis, it is only necessary to rotate the tongue retaining walls outwardly to disengage the flanges and retaining lips from the serrated ridges 24 and 27 of the tongue portion and by means of tab 28 peel the tongue from the tongue retaining portion of the strap. The hinged connnection between the base portion 32 and the tongue retaining walls in addition to providing an easy release for the tongue portion, also allows one to easily remove any snow which might accumulate on the strap while skiing and otherwise interfere with the functioning of the strap.

After removal of the strap 10 from the skis or the like, to fold the strap into a compact position for carrying, as illustrated in FIGS. 1–3, a natural fold 70 is provided at the center of the central strap portion 14 of the strap. The half of the central portion 72 adjacent the tongue retaining portion is first disposed within the tongue retaining portion over the teeth thereof as indicated in FIGS. 1 and 3; the half of the central portion 74 adjacent the tongue portion is then folded back over portion 72 and the tongue portion 12 of the strap is in turn folded back into the tongue retaining portion over portions 72 and 74 of the strap with the teeth 18 thereon extending outwardly from the tongue retaining portion. The tongue and central portion of the strap are then urged down into the tongue retaining portion against the teeth thereon with the serrated ridges 24 and 26 on the tongue portion extending into channels 38 and 40 in the tongue retaining portion. The tongue retaining walls are then moved inwardly with the flanges thereon being disposed about the extended lateral edges of the teeth 18 on the tongue portion and the retaining lips 62 and 64 extending into the longitudinal channels 20 and 22 in the tongue portion of the strap, thereby holding the strap in a compact folded position. When the strap 10 is affixed to the top of one of the skis, as illustrated in FIGS. 4 and 5, and is in the compact position, the tongue portion of the strap is securely held within the tongue receiving portion by the tongue retaining walls so as not to interfere in any manner with skiing nor present any potential hazard to the skier either while skiing or during a fall.

It is to be understood that various changes can be made in the length and construction of the central strap portion of the strap for use in securing together items other than skis. This and other changes and modifications may be made in carrying out the present invention without departing from the spirit and scope thereof. Insofar as these changes and modifications are within the purview of the appended claims, they are to be considered as part of the invention.

I claim:

1. An adjustable strap for holding together a pair of skis comprising a tongue portion, a tongue receiving portion and a foldable central strap portion extending therebetween, said tongue portion having a first plurality of locking teeth thereon and said tongue receiving portion including a base portion, a second plurality of locking teeth disposed on said base portion and being adapted to mate with said first plurality of teeth on said tongue portion and a pair of tongue retaining walls hingedly connected to said base portion and extending over and bearing against a portion of said tongue portion for holding said first and second pluralities of teeth in a mated relationship within said tongue receiving portion, said walls, upon disengaging said teeth and folding said central strap portion within said tongue receiving portion, extending over and bearing against a portion of said tongue portion for holding said central strap portion and said tongue portion within said tongue receiving portion.

2. An adjustable strap for holding together a pair of skis comprising a tongue portion, a tongue receiving portion and a foldable central strap portion extending therebetween, said tongue portion having a first plurality of locking teeth thereon and said tongue receiving portion including a base portion, a second plurality of locking teeth disposed on said base portion and being adapted to mate with said first plurality of teeth on said tongue portion and a pair of tongue retaining walls hingedly connected to said base portion and extending over a portion of said tongue portion for holding said first and second pluralities of teeth in a mated relationship within said tongue receiving portion, said tongue receiving walls including inwardly directed flange portions at the upper edges thereof and downwardly extending retaining lips at the inner edges of said flange portions and said tongue portion including a pair of longitudinally disposed channels adjacent the ends of said first plurality of locking teeth, said retaining lips being disposed within said channels upon disengaging said teeth and folding said central strap portion within said tongue receiving portion and said tongue portion being disposed within said tongue retaining portion over said central strap portion whereby said adjustable strap is maintained in a flat compact mode for carrying.

3. An adjustable strap for holding together a pair of skis comprising a flexible tongue portion, a tongue receiving portion and a central strap portion extending therebetween, said tongue portion having a first plurality of locking teeth extending laterally thereacross, a pair of longitudinally disposed channels extending through said teeth and spaced from the extended ends thereof and raised edge portions extending from the opposite side of said tongue portion from which said first plurality of locking teeth extend, and said tongue receiving portion including a base portion, a second plurality of locking teeth extending from and laterally across said base portion and being adapted to mate with said first plurality of teeth on said tongue portion to secure said tongue portion within said tongue receiving portion and a pair of tongue retaining walls hingedly connected to said base portion along opposite sides thereof, said walls being spaced from the extended ends of said second plurality of laterally extending teeth and having inwardly directed flange portions at the upper edges thereof and downwardly extending retaining lips at the inner edges of said flange portions to define a pair of locking channels adapted to receive said raised edge portions of said tongue portion upon said strap portion being disposed about a pair of skis, said retaining lips being disposed within said channels upon said central strap portion being bent back upon itself and disposed within said tongue retaining portion and said tongue being disposed within said tongue retaining portion over said central strap portion whereby an adjustable strap is maintained in a flat compact mode for carrying.

4. The combination of claim 3 wherein said adjustable strap is of integral construction and made of polypropylene.

5. The combination of claim 3 wherein said first plurality of locking teeth are disposed on the opposite side of said adjustable strap from said second plurality, said first plurality of teeth is sloped towards said tongue retaining portion of said strap and said second plurality of teeth is sloped towards said tongue portion of said strap so that upon disposing said tongue portion within said tongue retaining portion, and said first and second pluralities of teeth in a mating relationship, said tongue portion can be urged further into said tongue retaining portion but is prevented from being pulled therefrom.

6. The combination of claim 3 wherein said raised edge portions define serrated ridges to maintain flexibility in said tongue portion.

7. The combination of claim 6 wherein the spacing between adjacent teeth in said first plurality of teeth is substantially twice the spacing between adjacent teeth in said second plurality.

8. An adjustable strap for holding together a pair of skis comprising a tongue portion, a tongue receiving portion and a foldable central strap portion extending therebetween, said tongue portion having a first plurality of locking teeth thereon and said tongue receiving portion including a base portion, as adhesive for securing said base portion to a ski, a second plurality of locking teeth disposed on said base portion and being adapted to mate with said first plurality of teeth on said tongue portion and a pair of tongue retaining walls hingedly connected to said base portion and extending over a portion of said tongue portion for holding said first and second pluralities of teeth in a mated relationship within said tongue receiving portion, said tongue receiving walls including inwardly directed flange portions at the upper edges thereof and downwardly extending retaining lips at the inner edges of said flange portions and said tongue portion including a pair of longitudinally disposed channels adjacent the ends of said first plurality of locking teeth, said retaining lips being disposed within said channels upon disengaging said teeth and folding said central strap portion within said tongue receiving portion and said tongue portion being disposed within said tongue retaining portion over said central strap portion whereby said adjustable strap is maintained in a flat compact mode for carrying.

9. An assembly for holding together a pair of skis, said assembly comprising a ski and an adjustable strap secured to said ski, said strap further comprising a tongue portion, a tongue receiving portion and a foldable central strap portion extending therebetween, said tongue portion having a first plurality of locking teeth thereon and said tongue receiving portion including a base portion, a second plurality of locking teeth disposed on said base portion and being adapted to mate with said first plurality of teeth on said tongue portion and a pair of tongue retaining walls hingedly connected to said base portion and extending over and bearing against a portion of said tongue portion for holding said first and second pluralities of teeth in a mated relationship within said tongue receiving portion, said walls, upon disengaging said teeth and folding said central strap portion within said tongue receiving portion, extending over and bearing against a portion of said tongue portion for holding said central strap portion and said tongue portion within said tongue receiving portion whereby said strap can be maintained in a flat disposition between the side edges of said ski during use and thereby avoid interference with the use of said ski.

10. An adjustable strap for holding together a pair of skis comprising a tongue portion, a tongue receiving portion and a foldable central strap portion extending therebetween, said tongue portion having a first plurality of locking teeth thereon and said tongue receiving portion including a base portion, a second plurality of locking teeth disposed on said base portion and being adapted to mate with said first plurality of teeth on said tongue portion and a pair of tongue retaining walls hingedly connected to said base portion and extending over a portion of said tongue portion for holding said first and second pluralities of teeth in a mated relationship within said tongue receiving portion, said tongue receiving walls including inwardly directed flange portions at the upper edges thereof and downwardly extending retaining lips at the inner edges of said flange portions and said tongue portion including a pair of longitudinally disposed channels adjacent the ends of said first plurality of locking teeth, said retaining lips being disposed within said channels upon disengaging said teeth and folding said central strap portion within said tongue receiving portion and said tongue portion being disposed within said tongue retaining portion over said central strap portion whereby said adjustable strap is maintained in a flat compact disposition.

11. An adjustable strap for holding together a pair of skis comprising a tongue portion, a tongue receiving portion and a foldable central strap portion extending therebetween, said tongue portion having first locking means thereon and said tongue receiving portion having second locking means thereon, said second locking means being adapted to mate with said first locking means for securing said strap about said skis, and a pair of tongue retaining walls hingedly connected to said tongue receiving portion and being adapted to extend over a portion of said tongue portion for holding said first and second locking means in a mated relationship within said tongue receiving portion, said tongue retaining walls including inwardly directed flange portions at the upper edges thereof and downwardly extending retaining lips at the inner edges of said flange portions, said tongue portion including a pair of longitudinally disposed channels therein adjacent the longitudinal edges thereof, said retaining lips being disposed within said channels upon disengaging said first and second locking means and folding said central strap portion within said tongue receiving portion and disposing said tongue portion within said tongue receiving portion whereby said adjustable strap is maintained in a flat compact mode.

12. An adjustable strap assembly for holding together a plurality of objects, said strap comprising a tongue portion, a tongue receiving portion and a foldable central strap portion extending therebetween, said tongue portion having a first plurality of locking teeth thereon and said tongue receiving portion including a base portion, a second plurality of locking teeth disposed on said base portion and being adapted to mate with said first plurality of teeth on said tongue portion and a pair of tongue retaining walls hingedly connected to said base portion and extending over and bearing against a portion of said tongue portion for holding said first and second pluralities of teeth in a mated relationship within said tongue receiving portion, said walls, upon disengaging said teeth and folding said central strap portion within said tongue receiving portion, extending over and bearing against a portion of said tongue portion for holding said central strap portion and said tongue portion within said tongue receiving portion.

13. An adjustable strap assembly for holding together a plurality of objects, said strap comprising a tongue portion, a tongue receiving portion and a foldable central strap portion extending therebetween, said tongue portion having first locking means thereon and said tongue receiving portion having second locking means thereon, said second locking means being adapted to mate with said first locking means for securing said strap about said plurality of objects, and a pair of tongue retaining walls hingedly connected to said tongue receiving portion and being adapted to extend over a portion of said tongue portion for holding said first and second locking means in a mated relationship within said tongue receiving portion, said tongue retaining walls including inwardly directed flange portions at the upper edges thereof and downwardly extending retaining lips at the inner edges of said flange portions, said tongue portion including a pair of longitudinally disposed channels therein adjacent the longitudinal edges thereof, said retaining lips being disposed within said channels upon disengaging said first and second locking means and folding said central strap portion within said tongue receiving portion and disposing said tongue portion within said tongue receiving portion whereby said adjustable strap is maintained in a flat compact mode.

14. An adjustable strap assembly for holding together a plurality of objects, said strap comprising a tongue portion, a tongue receiving portion and a foldable central strap portion extending therebetween, said tongue portion having a first plurality of locking teeth thereon and said tongue receiving portion including a base portion, a second plurality of locking teeth disposed on said base portion and being adapted to mate with said first plurality of teeth on said tongue portion and a pair of tongue retaining walls hingedly connected to said base portion and extending over a portion of said tongue portion for holding said first and second pluralities of teeth in a mated relationship within said tongue receiving portion, said tongue receiving walls including inwardly directed flange portions at the upper edges thereof and downwardly extending retaining lips at the inner edges of said flange portions and said tongue portion including a pair of longitudinally disposed channels adjacent the ends of said first plurality of locking teeth, said retaining lips being disposed within said channels upon disengaging said teeth and folding said central strap portion within said tongue receiving portion and said tongue portion being disposed within said tongue retaining portion over said central strap portion whereby said adjustable strap is maintained in a flat compact mode for carrying.

* * * * *